United States Patent [19]

Veith

[11] 4,112,329

[45] Sep. 5, 1978

[54] GAS DISCHARGE DISPLAY DEVICE

[75] Inventor: Werner Veith, Munich, Fed. Rep. of Germany

[73] Assignee: Siemens Aktiengesellschaft, Berlin & Munich, Fed. Rep. of Germany

[21] Appl. No.: 783,720

[22] Filed: Apr. 1, 1977

[30] Foreign Application Priority Data

Apr. 9, 1976 [DE] Fed. Rep. of Germany ..... 2615721

[51] Int. Cl.[2] ..... H01J 61/067; H01J 61/30; H01J 61/42

[52] U.S. Cl. ..... 313/491; 313/220; 313/493

[58] Field of Search ..... 313/220, 188, 484, 485, 313/491, 493

[56] References Cited

U.S. PATENT DOCUMENTS

| | | | |
|---|---|---|---|
| 3,622,829 | 11/1971 | Watanabe | 313/491 |
| 3,956,667 | 5/1976 | Veith | 313/169 TV |

*Primary Examiner*—Palmer C. Demeo

*Attorney, Agent, or Firm*—Hill, Gross, Simpson, Van Santen, Steadman, Chiara & Simpson

[57] ABSTRACT

A gas discharge display device comprising a gas-filled, -gas-tight enclosure, an insulating matrix member dividing the housing into two chambers and comprising an insulating plate having a plurality of apertures therethrough, arranged in an array of rows and columns corresponding in number to a desired number of image points, a cathode electrode disposed in one chamber and extending parallel with the matrix plate, and a luminescent screen electrode disposed in the other chamber, a plurality of anode conductors disposed on the side of the plate facing said cathode electrode, and a plurality of control conductors disposed on the side of the plate facing the luminescent screen electrode. Each of the conductors extend around the edges of the associated apertures, with each of the conductors on one side being associated with a row of apertures, and each of the conductors on the other side being associated with a column of apertures. The cathode electrode is so disposed that a gas discharge can burn in the discharge chamber, and the luminescent screen electrode is disposed sufficiently close to the adjacent conductors on the matrix member, that even a few kV applied to such screen electrode cannot trigger any undesired gas discharge, with the effective size of the apertures in the control conductors adjacent the screen electrode being less than that of the corresponding apertures in the anode conductors adjacent the cathode electrode. The apertures preferably are elongated, for example oval or slot-shaped, and the holes in the control electrodes may be provided with cross bars subdividing such apertures. Various supporting structures for maintaining the components in rigid operation positions may be provided.

15 Claims, 7 Drawing Figures

GAS DISCHARGE DISPLAY DEVICE

BACKGROUND OF THE INVENTION

The invention relates to a gas discharge display device in the form of a plasma panel, comprising a gas filled, gas-tight enclosure in which an insulating matrix member, in the form of an insulating plate, divides the housing into two chambers. The insulating plate is provided with a plurality of apertures therethrough, arranged in an array of rows and columns corresponding in number to the desired number of image points. A plasma electrode is disposed in one chamber which may be in the form of a surface cathode extending parallel with the insulating matrix plate and provided with a luminescent screen electrode which is disposed in the other chamber. A plurality of anode conductors are disposed on the side of the plate facing the cathode electrode and a plurality of control conductors are disposed on the opposite side of the plate facing the screen electrode, with each of the conductors extending around the edges of the associated apertures, and each of the conductors on one side being associated with a respective row of apertures, and each of the conductors on the other side being associated with a respective column of apertures. The cathode electrode is so disposed that, upon application of appropriate potentials to the respective conductors and cathode electrode, a gas discharge can burn in the discharge chamber, and the luminescent screen electrode is disposed sufficiently close to the adjacent conductors on the matrix member that under such conditions a potential of even a few kV applied to such screen electrode cannot trigger any undesired gas discharge. Devices of this type have become known in various embodiments. See, for example, U.S. Pat. Nos. 3,622,829, 3,800,186, 3,845,241 and 3,956,667.

Normally, a gas discharge display contains merely a single chamber in which a plasma is produced, the radiation of which is employed either directly for the optical display or is employed to excite suitable phosphors. Single-chamber arrangements have already proved themselves many times, for example with respect to numerical displays, but their luminosity is not sufficient for the display of fairly large, rapidly changing quantities of information, for example moving pictures. As a result, in spite of considerable efforts, success has not been achieved, as yet, in producing a television picture screen with sufficient brilliance on the basis of such display constructions.

Special gas-discharge panels based on the following principle offer greater luminosity. In such arrangement, the display has two chambers, separated by a suitably perforated control structure. A plasma burns in the chamber at the rear of the structure, as viewed by the observer, while in the front chamber an acceleration anode is disposed a short distance from the control structure, with the distance being sufficiently short that no discharge will occur even with a potential difference of several kV on the anode, in accordance with the so-called Paschen curve. The electrons are drawn out of the discharge chamber through selectively actuated holes or apertures in the control structure, entering the front chamber where they are re-accelerated, impacting a phosphor disposed between the front plate and the acceleration anode. The electrons impact the phosphor with relatively high energy values, thus generating bright dots of light. Relatively high light yields can be obtained with such two-chamber displays, in which the gas discharge serves solely as a source of electrons.

By means of the above described electron generation and re-acceleration principle, utilizing a structure such as illustrated in said U.S. Pat. No. 3,956,667, especially high brightness values can be achieved. According to the concept therein developed, a normal corona burns between a surface electrode running parallel with a matrix member in the form of a control board or plate and the line conductor thereon actually being energized. With this electrode configuration, the cathode emits over virtually its entire area and a plasma is formed in the shape of a prism with the base on the cathode and one edge of the prism on the line being actuated. If the individual apertures in the actuated line are opened by activating the column conductors, disposed at the opposite side of the matrix member, large streams of electrons pass into such apertures, with the velocity spread in the streams of being especially small and the mean energy roughly corresponding to the electron temperature of the plasma.

In all two-chamber models, in particular the highly promising version with a wedge-shaped longitudinal discharge, the formation and technology of the control board or matrix member, with its conductors thereon, and the spacing of the member relative to the other electrodes are of particular importance. The greatest possible number of electrons diffusing towards the apertures in the member should be passed through the actuated apertures from the discharge chamber into the re-acceleration chamber, with the greatest possible bunching and the smallest possible energy scatter. No electrons must pass through the apertures that are not actuated at all or are only half actuated. In order to enable the performance of such control functions, it is not only important that the matrix member and its conductors be correctly designed, but it must also be ensured, above all, that the distance between the acceleration anode and the matrix conductors facing it remain constant over the entire display area. Otherwise the anode would produce locally varying effects on the extremely critical potential conditions in the individual matrix apertures.

It has not proved satisfactory to simply make the conductors carried by the matrix board of elongated, more or less rod-shaped with the conductors on opposed sides of the board crossing over in the centers of the apertures (see FIG. 1 of U.S. Pat. No. 3,622,829). The charged portions of the plasma then charge the edges of the holes in the insulating board whereby the passage of flux becomes impossible. Little improvement is achieved by constructing the column and line conductors of the matrix in strip-like form and provided with apertures having dimensions that are somewhat less than the corresponding diameter of the apertures in the insulating board, i.e. the electrodes mask the insulating member to a certain degree (see FIGS. 2–4 of U.S. Pat. No. 3,622,829), as the side walls of the apertures can still become charged, with unfavorable results. If the size of the apertures is increased, for example, to diameters of about 1 mm, while the charging troubles can be overcome, the influence of the acceleration anode becomes so great that passage of electrons through the apertures can no longer be completely blocked. It has been noted that with relatively large apertures a certain amount of flux constantly enters the re-acceleration chamber, which could not be made to disappear even when a strong negative bias potential, relative to the lines, was applied to the column conductors.

BRIEF SUMMARY OF THE INVENTION

The present invention therefore has among its objects the production of a two-chamber gas discharge display, provided with a matrix control member or board which provides clean, efficient control over the entire area of the screen, providing, in particular, excellent blocking of undesired radiation, and in which the cost of production and assembly remains within reasonable limits.

These desired results are achieved, in accordance with one feature of the invention, in a display device of the two chamber type, as specifically heretofore described, in that the apertures of the column conductors have a specific size and configuration, with respect to the other parameters involved, that they provide a very efficient control of the electron flow into the acceleration chamber, functioning in the manner of a control grid.

In accordance with the invention, the apertures of the column electrodes can be of elongated configuration, in particular oval or slot-shape.

In a further embodiment of the invention, the apertures of the line and column conductors are circular, but differ in size, with that of the column conductor apertures being smaller than those of the line conductors.

All three embodiments referred to have in common the fact that the effective size and configuration of the apertures of the column conductors is small as compared with those of the line or row apertures. Thus, the column conductor apertures may be in the form of a narrow mesh, provided with small narrow sides, or a small diameter, while the row apertures can be relatively large in area, without a grid formation, having relatively large broard sides or a large diameter.

With this construction, the danger of undesired wall charging is minimal and at the same time the penetration influence of the acceleration anode through the apertures in the control board is reduced to such a weak level that the apertures of an activated line can be adequately closed by the application of a negative bias of merely a few tens of volts to the column conductor involved, and when the column bias is increased, the corresponding matrix elements may be fully opened.

When the column conductors are so constructed that such a grid function takes place, the electron flow is responsive to exceedingly small blocking voltages and exceedingly small voltage increases. However, if the arrangement were to be restricted to conceivably simple structures such as a simple cross or cross member, such an embodiment could not be readily realized from a technological standpoint, and would require self-supporting grid elements.

The embodiments, in accordance with the invention, permit the matrix control member or board to be of minimal thickness, preferably no more than 0.6 mm and in particular between 0.2 and 0.3 mm, without any perceptible impairment of the control characteristics. The reduction in wall thickness has the advantage that the less the thickness, the less risk of the walls of the apertures becoming undesirably charged.

In a particularly suitable method for producing matrix control members or boards, merely two masks may be employed, with one mask being utilized to form the apertures in the conductive coatings, following which the apertures in the matrix member are formed with the same mask, and finally the specific conductor configurations are formed with a second mask. When the front plate of the display, which is usually of glass, is relatively thick, for example, thicker than 1.5 cm, for example for employment with a television picture screen 40×50 cm, the control electrodes can be spaced relative to the screen electrode by suitable support of the matrix board at various points from the front plate or suitable support from the back plate.

While thick front plates naturally are not as attractive as thin-walled embodiments in which the weight, utilization of materials and the space required by the arrangement can be reduced materially, a picture screen having the referred-to dimensions of 40×50 cm, and a wall thickness of less than 1 cm, for example 0.5 cm, would bend substantially under the external pressure, particularly, to such an extent that the control matrix would no longer be properly spaced therefrom. Consequently, under such constructions additional provisions must be made to provide adequate support and maintain adequate spacing between the operational components of the device. This can be accomplished by the utilization of suitable mechanical arrangements which provide the desired reinforcement and rigidity, and at the same time do not exert any notable influence on the electron production and re-acceleration operations.

Display devices in accordance with the invention have particular application as television picture screens and in particular are suitable for operation with a wedge-shaped corona emanating from a surface cathode, as heavy electron streams may be adequately controlled.

BRIEF DESCRIPTION OF THE DRAWINGS

In the drawings, wherein like reference numerals indicate like or corresponding parts.

Figure 1:
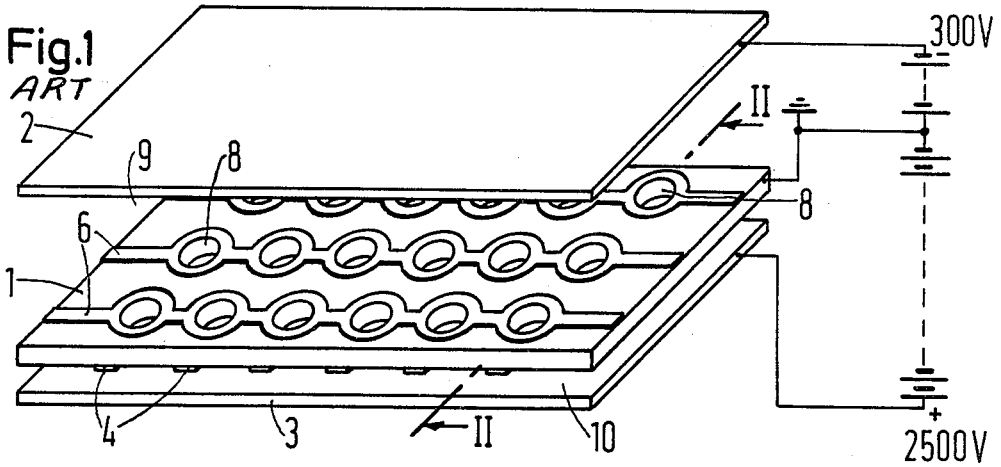
Fig.1 PRIOR ART
FIG. 1 is an exploded view, in isometric, of a matrix control member or board provided with column and line conductors, a surface cathode and an acceleration anode in a two-chamber configuration, forming a display device of the type illustrated in U.S. Pat. No. 3,956,667, and illustrating the arrangement of the various components and applicable operating potentials.

For the sake of clarity, all of the figures are greatly simplified, with any of the individual parts of a gas-discharge panel not absolutely necessary for an understanding of the invention, for example electrode potential supplies and actuating circuits, not being included in the drawings.

DETAILED DESCRIPTION OF THE INVENTION

Referring to the drawings, and more particularly to FIG. 1, there is illustrated a display device, omitting the enclosure and may mounting elements, etc. which is provided with a matrix control board or member 1 of insulating material which is positioned between a flat cathode 2, forming a surface cathode, and a similarly flat anode 3, forming an acceleration or screen anode, with all three parts disposed in parallel relation with respect to one another. The anode, as viewed by an observer, is disposed in front of, or before, the control board, while the cathode is disposed therebehind. The front and rear faces of the control board each carry parallel conductor paths forming column conductors or control electrodes 4, and row or line conductors or anode electrodes 6, which are respectively provided with apertures 7 and 8 at their points of intersection. The control board is also provided at the same points with apertures or holes 28, whereby a uniform apertured matrix is produced, with the control unit thus comprising the board and its cooperable conductor paths. It will be apparent that the allocation of the column, and row or line conductors, to the cathode or anode sides of the control board is arbitrary and can of course be va ed, i.e. reversed.

In operation of the display structure illustrated, the surface cathode has a negative bias of about 300 V relative to the anode electrode being actuated at any particular time, with the actuated line lying at ground potential, while the other lines merely "float", i.e. assume the potential of their surroundings, and do not affect the discharge taking place between the cathode and the actuated line. The unactivated column conductors have a negative bias of about 30 to 40 V, relative to ground, which is raised to 0 V upon actuation, and the acceleration anode may, for example, lie at a potential of a few kV, for example +2500 V. The distances between the individual electrodes are so selected that a corona normally exists in the discharge chamber 9 between the surface cathode and the line conductors, while no plasma can develop in the re-acceleration chamber 10 between the screen and the column conductors because of the relatively small spacing between such electrodes. If the control board apertures are now selectively activated, they will permit electrons to pass from the discharge chamber to the re-acceleration chamber, with such electrons being accelerated and finally impacting the screen anode, generating a bright spot of light on the phosphor disposed at the opposite side of such screen anode.

Further details with respect to the production and operation of display devices of this type can be derived from the cited publications, particularly U.S. Pat. No. 3,956,667 and allowed U.S. application Ser. No. 647,991, now U.S. Pat. No. 4,047,077.

Figure 2:
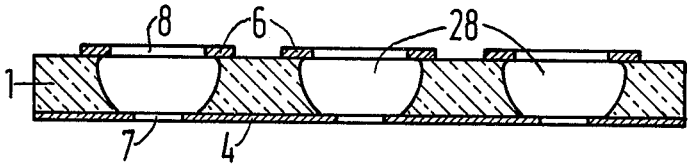
FIG. 2 is a transverse sectional view of a portion of such a control board, embodying a first example of the invention, taken approximately on a line generally corresponding to the line II—II of FIG. 1.
Figure 3:
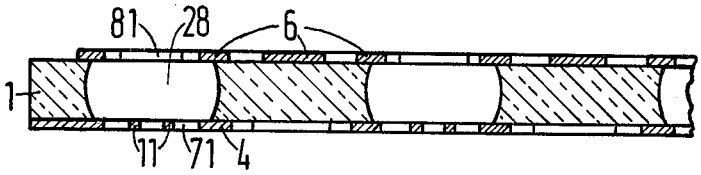
FIG. 3 is a transverse sectional view, similar to FIG. 2, taken approximately on the line III—III of FIG. 4 and illustrating a further embodiment of the invention.
Figure 4:
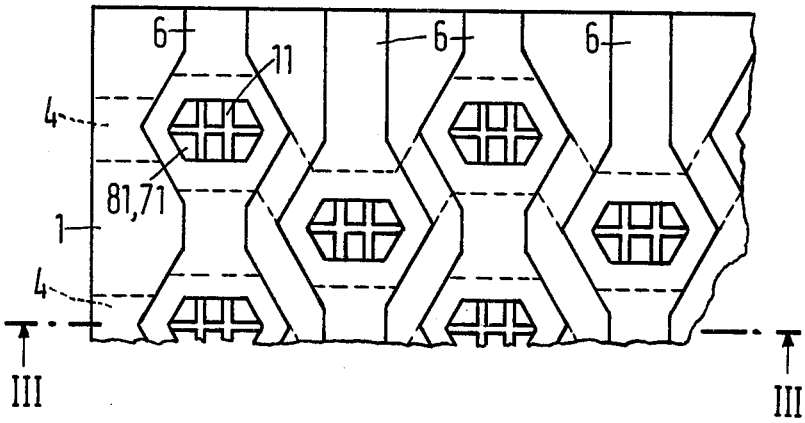
FIG. 4 is a top plan view of a portion of a control board such as illustrated in FIG. 3.

FIGS. 2–4 illustrate two different examples of control boards in accordance with the present invention, which differ primarily in the form of the conductor apertures. Thus, in the embodiment of FIG. 2, the individual column and line apertures are circular, with the column apertures being less in diameter than that of the line apertures. In this arrangement on activation, equipotential areas, converging towards the discharge chamber are formed in the individual channels of the control unit, which equipotential areas deflect the incoming electrons toward the central axis of the channel and thus ensure that the transmission factor remains about the same in spite of the reduction in size of the column apertures, and thus also largely prevents charging of the side walls.

In the embodiment illustrated in FIGS. 3 and 4, the lines 6 and columns 4 have respective slot-shaped apertures 71, 81, respectively, which are provided with converging end walls. In addition, the column apertures 71 each have three bars or cross members 11 extending thereacross. As will be apparent from a reference to FIG. 4, all the apertures 71, 81 are disposed with their long sides extending in the direction corresponding to that of the columns, with the apertures 81 of the even-numbered lines 6 being disposed in offset relation with respect to the apertures 81 of the odd-numbered lines 6. This arrangement has the advantage that each line can contain a very large number of apertures, while simultaneously insuring that adequate space will remain between the apertures of neighboring lines to accommodate the spaced conducting edges of the apertures. With suitable elongated apertures, physical grid structures in the column conductor apertures can be omitted. Tests have indicated that considerably improved results can be achieved with oval apertures as compared with circular apertures of the same area.

Figure 5:
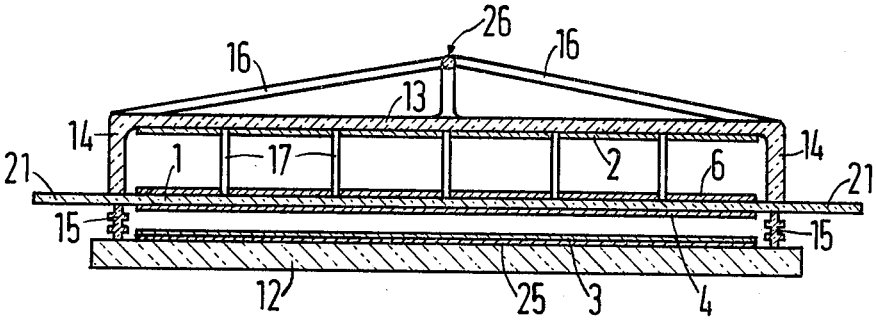
FIG. 5 is a transverse sectional view illustrating one form of supporting structure for a matrix board in a device embodying the invention.

FIG. 5 illustrates details of an assembled display structure, in accordance with the present invention, for employment as a flat television picture screen. In addition to the matrix control board or member 1, additional components are illustrated which include a relatively thick front plate 12 and a back plate 13, together with side walls 14, and a spacing member 15 between the board 1 and the front plate 12. Suitable members or struts 16 extending from the middle and the corners and centers of the back plate 13, converge at a point behind the back plate 13, which are employed for the purpose of providing an increased mechanical strength and rigidity of the entire display structure. The spacing member or frame 15 comprises alternately thick and thin peripherally extending portions forming annularly shaped internal and external ribs, thus providing a relatively very long surface path between the front plate and the control board for the high voltage employed. All of the parts thus far described can be made of glass and fused together to form a single integral structure of extraordinary mechanical strength. The internal surface of the glass front plate 12 is coated with a suitable phosphor 25 with the screen anode 3 overlying the phosphor coating.

The internal face of the back plate 13 carries the surface cathode 2 and for the sake of simplicity and clarity, the respective line and column electrodes applied to the respective faces of the control board are illustrated merely as continuous coatings. In the present instance, the respective electrode conductors 4 and 6 may be made of precipitated etched NiCr, while the cathode may be formed from a low-sputter material such as Al and the screen anode likewise may be constructed of Al. Known phosphor compounds, which can be excited by low-energy electrons, may be employed for the phosphor coating (see Proc. IEEE, 61, 1973, pages 1025–1029), and the structure may be filled with a gas such as $H_2$, Ne, He, $N_2$.

To insure the accurate spacing between the components of the structure, particularly, to insure that the control board 1 remains at the desired distance from the acceleration electrode 3 at all points, i.e., from the glass front plate 12, the control board 1 is rigidly connected to the back plate 13 by means of a plurality of small ceramic rods 17 suitably spaced throughout the area of the board and back plate. If necessary, the length of such rods can be suitably varied in correspondence to the bending action of the two plates 12 and 13 under atmospheric pressure, whereby the control board will bend in a manner corresponding to that of the glass front plate. With the employment of such a construction, the distance between the surface cathode and the control board becomes smaller near the center of the screen unless counter-measures are utilized, but as a rule this effect does not have any material influence on the gas discharge and could be compensated, if necessary or desirable, by appropriately curving the surface cathode.

Figure 6:
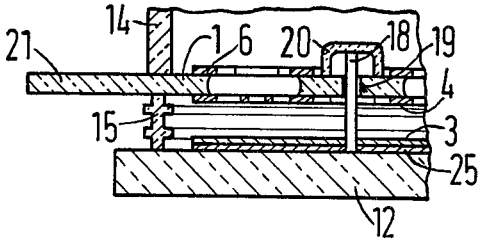
FIG. 6 is a sectional view similar to FIG. 5 of a portion of a modified supporting structure.

FIG. 6 illustrates a particular effective method of supporting the control board directly from the glass front plate, rather than the back plate. In this arrangement ceramic rods or pins 18 are secured to the glass front plate and extend through holes 19 specifically provided therefor in the control board 1, with the pins extending into the discharge chamber and disposed in cup-like ceramic elements 20 which enclose the free ends of the pins. In this case adjacent ends of the pins are secured to the face plate 12 and the opposite ends of the pins are secured to the bottom or base wall of the associated cup-shaped element 20, while the rims or edges of the latter are secured to the control board 1. The pins 18 and cup-shaped members 20 should be constructed of an insulating material and the outer wall of the members 20 should not be metalized, whereby the influence on the plasma is maintained as low as possible. The spacing elements thus provide a relatively long surface path between the control board and the acceleration anode which in contrast thereto, has a positive bias of several kV and is physically disposed only about 1 mm therefrom.

In the one-sided board supporting arrangements of FIGS. 5 and 6, the control board is subjected to certain tensile loadings, i.e. the control board must curve with the connection plate, for example, the front plate in FIG. 6. Consequently, it may be desirable in some cases to provide flexible control structures. For example, such elasticity could be achieved in a control board which is reduced, by severe etching, to insulated islands, in which case the electrode paths separated by such islands would have to be self-supporting.

In all of the embodiments illustrated, the control board 1 is illustrated as projecting from the glass enclosure, and components of the actuating circuit for the device, as for example shift registers, counters, stores, drivers and switches, may be located on the peripheral areas of the board extending without the enclosure, with the necessary supply lines to the individual electrodes within the enclosure extending through the enclosure walls.

Figure 7:
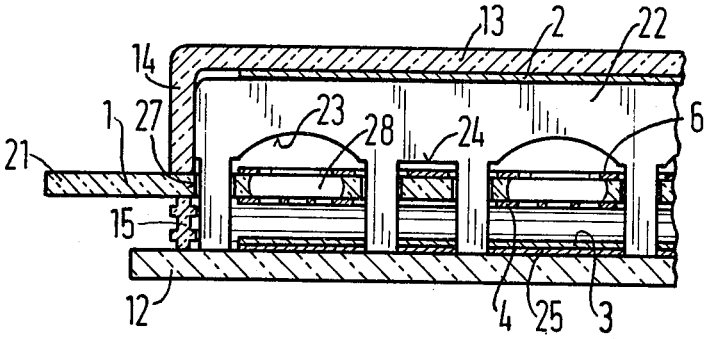
FIG. 7 is a sectional view similar to FIG. 5 of a portion of a further modification of the supporting structure.

If the picture screen involves the use of a relatively thin-walled glass front plate that would be subject to severe deflection under atmospheric pressure, it is better not to attempt to conform the control board to the curved face of the front plate, but instead to prevent undesired deflection of the front plate. FIG. 7 illustrates a further embodiment of the invention and shows how such a rigid, virtually unbreakable structure can be achieved. In this modification, the interior of the enclosure is divided into sections by parallel supporting plates or walls 22. The latter are provided with recesses 23,24 which are cut into each of the supporting plates 22 from the side thereof adjacent the front plate and extend into the discharge chamber with the plates 22 being secured to the back plate 13 along their adjacent edges. The portions of the plates intermediate the recesses 23,24 extend through slots 27 in the control board and have their free ends secured to the glass front plate 12. The recesses 23,24 extending into the discharge chamber, assure a cohesive, mechanically strong control board and prevent the possibility of any of the line conductors being cut, as well as insure that an unobstructed space is maintained in the discharge chamber in front of all the line apertures. If necessary, the liner apertures in the immediate vicinity of the individual supporting plates could be slightly offset from their actual screen position, or suitably modified as to configuration, with the luminescent dots on the phosphor screen remaining in operative relation thereto.

The supporting-plate construction described in primarily designed for use with a surface cathode, as the wedge-shaped discharge produced thereby, while split several times, is otherwise not materially distorted, and in particular is not materially weakened. In this construction, it is not necessary to employ supporting plates which extend continuously up to the side walls, and the suports can readily cover no more than a few lines. The gap between adjacent supporting plates in line direction should always be as large as possible, consistent with mechanical requirements and, as a rule, it will be several times the spacing between picture dots.

It will be appreciated that the invention is not limited to the specific examples illustrated in the drawings. For example, the proposed control board configuration and spacing also is applicable to structures in which the gas discharge is produced by means other than a surface cathode, for example when a transverse plasma is generated between two plasma electrodes. In addition, one skilled in the art may combine the proposed measures in different combinations, for example employing oval column apertures with a grid in the electrode paths on the control plate or form all the apertures in an elongated form and thereby make the column conductor slots or apertures smaller than those of the line conductors. It is also possible, within the concept of the invention, to employ a control board comprising independent islands and/or to vary the structure of the conductor paths within wide limits, particularly to dispose the relative positions of the individual apertures in accordance with the optical resolution requirements.

Having thus described my invention it will be obvious that although various minor modifications might be suggested by those versed in the art, it should be understood that I wish to embody within the scope of the patent granted hereon all such modifications as reasonably, and properly come within the scope of my contribution to the art.

I claim as my invention:

1. A gas discharge display device, comprising a gas-filled, gas-tight enclosure, an insulating matrix member dividing the enclosure into two chambers, which is in the form of an insulating plate having a plurality of apertures therethrough, arranged in an array of rows and columns corresponding in number to a desired number of image points, a plasma electrode disposed in one chamber, and a luminescent screen electrode disposed in the other chamber, a plurality of anode conductors disposed on the side of said plate facing said plasma electrode, and a plurality of control conductors disposed on the side of said plate facing said luminescent screen electrode, each of the conductors extending around the edges of the associated apertures, with each of the conductors on one side being associated with a row of apertures, and each of the conductors on the other side being associated with a column of apertures, said column conductor apertures having an elongated configuration, in particular an oval or slot-shaped configuration, the plasma electrode being so disposed that upon application of appropriate potentials to the respective conductors and plasma electrode a gas discharge can burn in the discharge chamber and the luminescent screen electrode is disposed sufficiently close to the adjacent conductors on the matrix member, that under such conditions even a few kV applied to such screen electrode cannot trigger any undesired gas discharge, the effective size of the apertures in the control conductors adjacent said screen electrode having a sufficiently small size and configuration that an effective control grid action results with respect to electron flow through the aperture.

2. A gas discharge display device, comprising a gas-filled, gas-tight enclosure, an insulating matrix member dividing the enclosure into two chambers, which is in the form of an insulating plate having a plurality of apertures therethrough, arranged in an array of rows and columns corresponding in number to a desired number of image points, a plasma electrode disposed in one chamber, and a luminescent screen electrode disposed in the other chamber, a plurality of anode conductors disposed on the side of said plate facing said plasma electrode, and a plurality of control conductors disposed on the side of said plate facing said luminescent screen electrode, each of the conductors extending around the edges of the associated apertures, with each of the conductors on one side being associated with a row of apertures, and each of the conductors on the other side being associated with a column of apertures, said apertures in the column and row conductors being round with the column conductor apertures being smaller than the row conductor apertures, the plasma electrode being so disposed that upon application of appropriate potentials to the respective conductors and plasma electrode a gas discharge can burn in the discharge chamber and the luminescent screen electrode is disposed sufficiently close to the adjacent conductors on the matrix member, that under such conditions even a few kV applied to such screen electrode cannot trigger any undesired gas discharge, the effective size of the apertures in the control conductors adjacent said screen electrode having a sufficiently small size and configuration that an effective control grid action results with respect to electron flow through the aperture.

3. A gas discharge display device, particularly for a television picture screen, comprising a gas-filled, gas-tight enclosure, an insulating matrix member dividing the enclosure into two chambers, said enclosure including a back plate and a front plate greater than 1.5 cm in thickness and a plurality of rods, made of electrically insulating material, extending transversely to and distributed over the face of the matrix member, said rods being connected at their respective ends to the matrix member and the back plate, said matrix member being in the form of an insulating plate having a plurality of apertures therethrough, arranged in an array of rows and columns corresponding in number to a desired number of image points, a plasma electrode disposed in one chamber, and a luminescent screen electrode disposed in the other chamber, a plurality of anode conductors disposed on the side of said plate facing said plasma electrode, and a plurality of control conductors disposed on the side of said plate facing said luminescent screen electrode, each of the conductors extending around the edges of the associated apertures, with each of the conductors on one side being associated with a row of apertures, and each of the conductors on the other side being associated with a column of apertures, the plasma electrode being so disposed that upon application of appropriate potentials to the respective conductors and plasma electrode a gas discharge can burn in the discharge chamber and the luminescent screen electrode is disposed sufficiently close to the adjacent conductors on the matrix member, that under such conditions even a few kV applied to such screen electrode cannot trigger any undesired gas discharge, the effective size of the apertures in the control conductors adjacent said screen electrode having a sufficiently small size and configuration that an effective control grid action results with respect to electron flow through the aperture.

4. A display device according to claim 3, wherein the length of said rods so decreases from the edge of the matrix member towards the middle that, when the display device is completely assembled and gas-filled, the matrix member is curved in correspondence to the concavity of the front plate resulting from the external pressure.

5. A display device according to claim 3, wherein said rods form a pattern running at an angle to the coordinate conductor matrix configuration.

6. A gas discharge display device, comprising a gas-filled, gas-tight enclosure, an insulating matrix member dividing the enclosure into two chambers, a back plate and a front plate greater than 1.5 cm thick, said matrix member being spaced relative to the front plate by means of a plurality of rods, of electrically insulating material, distributed over the face of the matrix member, the latter having openings therein, with the rods extending from the front plate, through said openings in spaced relation with respect to the matrix member, and projecting into the rear discharge chamber, with the rods making contact at each of their adjacent ends with the interior bottom of a respective cup-shaped member of insulating material secured to the matrix member, the latter being in the form of an insulating plate having a plurality of apertures therethrough, arranged in an array of rows and columns corresponding in number to a desired number of image points, a plasma electrode disposed in one chamber, and a luminescent screen electrode disposed in the other chamber, a plurality of anode conductors disposed on the side of said plate facing said plasma electrode, and a plurality of control conductors disposed on the side of said plate facing said luminescent screen electrode, each of the conductors extending around the edges of the associated apertures, with each of the conductors on one side being associated with a row of apertures, and each of the conductors on the other side being associated with a column of apertures, the plasma electrode being so disposed that upon application of appropriate potentials to the respective conductors and plasma electrode a gas discharge can burn in the discharge chamber and the luminescent screen electrode is disposed sufficiently close to the adjacent conductors on the matrix member, that under such conditions even a few kV applied to such screen electrode cannot trigger any undesired gas discharge, the effective size of the apertures in the control conductors adjacent said screen electrode having a sufficiently small size and configuration that an effective control grid action results with respect to electron flow through the aperture.

7. A display according to claim 6, wherein said rods form a pattern running at an angle to the coordinate conductor matrix configuration.

8. A gas discharge display device, comprising a gas-filled, gas-tight enclosure, an insulating matrix member dividing the enclosure into two chambers, which is in the form of an insulating plate having a plurality of apertures therethrough, arranged in an array of rows and columns corresponding in number to a desired number of image points, a plasma electrode disposed in one chamber, and a luminescent screen electrode disposed in the other chamber, a plurality of anode conductors disposed on the side of said plate facing said plasma electrode, and a plurality of control conductors disposed on the side of said plate facing said luminescent screen electrode, each of the conductors extending around the edges of the associated apertures, with each of the conductors on one side being associated with a row of apertures, and each of the conductors on the other side being associated with a column of apertures, the plasma electrode being so disposed that upon application of appropriate potentials to the respective conductors and plasma electrode a gas discharge can burn in the discharge chamber and the luminescent screen electrode is disposed sufficiently close to the adjacent conductors on the matrix member, that under such conditions even a few kV applied to such screen electrode cannot trigger any undesired gas discharge, the effective size of the apertures in the control conductors adjacent said screen electrode having a sufficiently small size and configuration that an effective control grid action results with respect to electron flow through the aperture, said enclosure including a back plate and a front plate less than 1 cm thick, the front plate being spaced relative to the back plate by means of a plurality of supporting plates which pass through openings in the matrix plate and extend at right angles to the row conductors.

9. A display device according to claim 8, wherein said supporting plates preferably extend approximately from one edge to the other of the rear chamber of the housing.

10. A display device according to claim 9, wherein the supporting plates have recesses on their sides facing the front plate, which extend into the discharge chamber with the parts of the plates remaining between the recesses extending through additional openings in the matrix member.

11. A display device according to claim 10, wherein the recesses in the supporting plates are arranged and shaped such that no line conductor or conductor aperture is severed.

12. A display device according to claim 11, wherein the housing includes a spacing wall between the matrix member and the front plate, which spacing wall has alternately thick and thin peripheral extending portions forming annularly shaped internal and external ribs.

13. A gas discharge display device, comprising a gas-filled, gas-tight enclosure, an insulating matrix member dividing the enclosure into two chambers, said enclosure including a spacing wall between the matrix member and the front plate, which spacing wall has alternately thick and thin peripheral extending portions forming annularly shaped internal and external ribs, said matrix member being in the form of an insulating plate having a plurality of apertures therethrough, arranged in an array of rows and columns corresponding in number to a desired number of image points, a plasma electrode disposed in one chamber, and a luminescent screen electrode disposed in the other chamber, a plurality of anode conductors disposed on the side of said plate facing said plasma electrode, and a plurality of control conductors disposed on the side of said plate facing said luminescent screen electrode, each of the conductors extending around the edges of the associated apertures, with each of the conductors on one side being associated with a row of apertures, and each of the conductors on the other side being associated with a column of apertures, the plasma electrode being so disposed that upon application of appropriate potentials to the respective conductors and plasma electrode a gas discharge can burn in the discharge chamber and the luminescent screen electrode is disposed sufficiently close to the adjacent conductors on the matrix member, that under such conditions even a few kV applied to such screen electrode cannot trigger any undesired gas discharge, the effective size of the apertures in the control conductors adjacent said screen electrode having a sufficiently small size and configuration that an effective control grid action results with respect to electron flow through the aperture.

14. A gas discharge display device, comprising a gas-filled, gas-tight enclosure, an insulating matrix member dividing the enclosure into two chambers, which is in the form of an insulating plate having a plurality of apertures therethrough, arranged in an array of rows and columns corresponding in number to a desired number of image points, the column conductor apertures having a grid configuration, a plasma electrode disposed in one chamber, and a luminescent screen electrode disposed in the other chamber, a plurality of anode conductors disposed on the side of said plate facing said plasma electrode, and a plurality of control conductors disposed on the side of said plate facing said luminescent screen electrode, each of the conductors extending around the edges of the associated apertures, with each of the conductors on one side being associated with a row of apertures, and each of the conductors on the other side being associated with a column of apertures, the plasma electrode being so disposed that upon application of appropriate potentials to the respective conductors and plasma electrode a gas discharge can burn in the discharge chamber and the luminescent screen electrode is disposed sufficiently close to the adjacent conductors on the matrix member, that under such conditions even a few kV applied to such screen electrode cannot trigger any undesired gas discharge, the effective size of the apertures in the control conductors adjacent said screen electrode having a sufficiently small size and configuration that an effective control grid action results with respect to electron flow through the aperture.

15. A gas discharge display device, comprising a gas-filled, gas-tight enclosure, an insulating matrix member dividing the enclosure into two chambers, which is in the form of an insulating plate having a plurality of apertures therethrough, arranged in an array of rows and columns corresponding in number to a desired number of image points, a plasma electrode disposed in one chamber, and a luminescent screen electrode disposed in the other chamber, a plurality of anode conductors disposed on the side of said plate facing said plasma electrode, and a pluraity of control conductors disposed on the side of said plate facing said luminescent screen electrode, each of the conductors extending around the edges of the associated apertures, with each of the conductors on one side being associated with a row of apertures, and each of the conductors on the other side being associated with a column of apertures, the plasma electrode being so disposed that upon application of appropriate potentials to the respective conductors and plasma electrode a gas discharge can burn in the discharge chamber and the luminescent screen electrode is disposed sufficiently close to the adjacent conductors on the matrix member, that under such conditions even a few kV applied to such screen electrode cannot trigger any undesired gas discharge, the effective size of the apertures in the control conductors adjacent said screen electrode having a sufficiently small size and configuration that an effective control grid action results with respect to electron flow through the aperture, said enclosure including a front plate and a plurality of spacing members extending between the matrix member and the front plate, said spacing members having a configuration providing a relatively long surface path, between the matrix member and the front plate that is greater than the distance therebetween.

* * * * *